US011202937B2

(12) United States Patent
Penxa

(10) Patent No.: US 11,202,937 B2
(45) Date of Patent: Dec. 21, 2021

(54) INTERCHANGEABLE BOWLING APPARATUS

(71) Applicant: Jerome M. Penxa, Shelby Township, MI (US)

(72) Inventor: Jerome M. Penxa, Shelby Township, MI (US)

(73) Assignee: JOPO GRIPS, LLC, Shelby Township, MI (US)

( * ) Notice: Subject to any disclaimer, the term of this patent is extended or adjusted under 35 U.S.C. 154(b) by 0 days.

(21) Appl. No.: 16/392,373

(22) Filed: Apr. 23, 2019

(65) Prior Publication Data

US 2019/0321686 A1 Oct. 24, 2019

Related U.S. Application Data

(60) Provisional application No. 62/661,381, filed on Apr. 23, 2018.

(51) Int. Cl.
*A63B 37/00* (2006.01)
*B25B 15/02* (2006.01)

(52) U.S. Cl.
CPC .. *A63B 37/0002* (2013.01); *A63B 2243/0054* (2013.01); *B25B 15/02* (2013.01)

(58) Field of Classification Search
CPC ..... A63B 37/002; A63B 2243/0054
USPC ..... 473/129, 130
See application file for complete search history.

(56) References Cited

U.S. PATENT DOCUMENTS

| | | | |
|---|---|---|---|
| 533,011 | A | 1/1895 | Huntoon |
| 712,192 | A | 10/1902 | Immen |
| 1,080,307 | A | 12/1913 | Sondheimer |
| 2,210,528 | A | 8/1940 | Darby |
| 2,314,811 | A | 3/1943 | Akin |
| 2,435,327 | A | 2/1948 | Seurynck |
| 2,436,976 | A | 3/1948 | Seurynck |
| 2,460,385 | A | 2/1949 | Hausman |

(Continued)

OTHER PUBLICATIONS

Screw Threads and Conventional Representations, Colin H Simmons I.Eng, FIED, Mem ASME., . . . Neil Phelps IEng MIED, MIET, in Manual of Engineering Drawing (Third Edition), https://www.sciencedirect.com/topics/engineering/thread-pitch, 2009.*

(Continued)

*Primary Examiner* — William M Pierce
(74) *Attorney, Agent, or Firm* — Brooks Kushman P.C.

(57) ABSTRACT

An interchangeable finger insert system for a bowling ball is provided. An inner sleeve has a cylindrical opening defined at a top end. A base encloses a bottom end of the inner sleeve. A fastener-head feature is defined in the base and accessible through the cylindrical opening. An engagement feature is formed along an exterior surface and configured to allow the inner sleeve to be rotationally inserted into an internal bore. A fastening tool with an elongated shaft and a locking feature defined at a distal end of the shaft is provided. The locking feature shaped to engage the fastener-head feature defined on the inner sleeve. The locking feature of the fastening tool engages the fastener-head feature on the inner sleeve, and rotation of the fastening tool is configured to rotate the inner sleeve into the internal bore thereby locking the inner sleeve in the bowling ball.

13 Claims, 3 Drawing Sheets

(56) References Cited

U.S. PATENT DOCUMENTS

| | | | | | |
|---|---|---|---|---|---|
| 2,646,985 | A | | 7/1953 | Nagy et al. | |
| 2,842,367 | A | | 7/1958 | Keith | |
| 2,844,375 | A | | 7/1958 | Nestor | |
| 2,950,111 | A | | 8/1960 | Kunevicius | |
| 3,001,793 | A | * | 9/1961 | Insetta | A63B 37/0002 473/130 |
| 3,004,762 | A | | 10/1961 | Frost | |
| 3,012,783 | A | | 12/1961 | Bunk et al. | |
| 3,102,725 | A | | 9/1963 | Jarus | |
| 3,129,002 | A | * | 4/1964 | Bednash | A63B 37/0002 473/129 |
| 3,416,796 | A | | 12/1968 | Ginder | |
| 3,804,412 | A | | 4/1974 | Chetirko | |
| 3,861,681 | A | | 1/1975 | Kelsey | |
| 4,247,102 | A | | 1/1981 | Seyler | |
| 4,289,312 | A | | 9/1981 | Heimbigner | |
| 4,358,112 | A | | 11/1982 | Straborny | |
| 4,416,452 | A | | 11/1983 | Heimbigner | |
| 4,560,162 | A | | 12/1985 | Miller | |
| 4,561,654 | A | | 12/1985 | Haza | |
| 4,569,520 | A | | 2/1986 | Yamane | |
| 4,585,230 | A | | 4/1986 | Martin | |
| 4,623,149 | A | | 11/1986 | Herman | |
| 4,699,380 | A | | 10/1987 | Mace | |
| 4,778,178 | A | | 10/1988 | Haza | |
| 4,892,308 | A | * | 1/1990 | Gaunt | A63B 37/0002 473/129 |
| 4,968,033 | A | | 11/1990 | Aluotto | |
| 5,118,106 | A | | 6/1992 | Goldman | |
| 5,308,061 | A | | 5/1994 | Bernhardt | |
| 5,505,666 | A | | 4/1996 | Arsenault | |
| 5,520,582 | A | | 5/1996 | Lathrop | |
| 5,738,592 | A | | 4/1998 | Saunders | |
| 5,795,236 | A | | 8/1998 | Alberts et al. | |
| 5,800,276 | A | | 9/1998 | Hill | |
| 6,280,343 | B1 | | 8/2001 | Scheid et al. | |
| 6,830,518 | B2 | | 12/2004 | Graskewicz | |
| 7,044,863 | B1 | | 5/2006 | Brewster | |
| 7,048,636 | B1 | * | 5/2006 | Sill | A63B 37/0002 473/129 |
| 7,074,130 | B2 | | 7/2006 | Haisley | |
| 7,762,903 | B2 | | 7/2010 | Bernhardt | |
| 9,387,364 | B2 | | 7/2016 | Penxa | |
| 2009/0048033 | A1 | | 2/2009 | Shockley | |
| 2015/0119156 | A1 | * | 4/2015 | Penxa | A63B 37/0002 473/130 |

OTHER PUBLICATIONS

<http://www.ncaba.org/bowlmag/archives/9710scot.htm> (Oct. 10, 2013).
<http://www.premierbowlers.com/it.htm> (Oct. 10, 2013).
<http://www.bowl.com/Equipment_Specs/Additional_Resources/Approved_Removable_Bowling Ball Devices> (Oct. 9, 2013).
<http://www..turbogrips.com/products_switch_grip.php> (Oct. 9, 2013).

* cited by examiner

INTERCHANGEABLE BOWLING APPARATUS

CROSS-REFERENCE TO RELATED APPLICATIONS

This application claims the benefit of U.S. provisional application Ser. No. 62/661,381 filed Apr. 23, 2018, the disclosure of which is hereby incorporated in its entirety by reference herein.

TECHNICAL FIELD

The present disclosure relates to interchangeable finger inserts for a bowling ball.

BACKGROUND

Bowling balls employ a variety of drill patterns for three-hole layouts. Two upper finger holes are separated laterally from each other by a bridge distance. The thumb hole is separated from the finger holes by a span distance. Depending on a bowler's preference, the finger hole pattern may be drilled at an off-center position relative to the center of gravity of the ball to achieve a desired influence on ball trajectory. This allows bowlers to have a preferable amount of tracking, or curved trajectory, on the ball's approach toward bowling pins.

Bowlers may have a range of release types that also influence ball trajectory. A bowler with high speed and little hand rotation will have relatively low hooking action, particularly toward the back end of the roll. Likewise, a bowler with a lower ball speed and more hand rotation will tend to have much larger hooking action and a stronger back-end hook. During the initial portion of a ball approach, the force related to ball linear velocity may greatly outweigh the rotational force, and the ball may skid in a relatively straight direction while rotating in an oblique direction. During a middle portion of the ball approach, the force from oblique rotation influences ball trajectory, causing a hooking pattern of motion. Once the pattern changes, the ball begins to roll more in an oblique direction to approach the pins from an indirect angle.

The release type of a bowler's throw may make it desirable for a custom finger interface for the bowler to have more consistent control over the release. Unique finger hole shapes may be suitable to enhance bowler comfort as well as ball control. A custom finger interface may be beneficial for the finger and/or the thumb holes of a bowling ball.

SUMMARY

In at least one embodiment, an interchangeable finger insert for a bowling ball has a cylindrical inner slug having an inner cavity extending from a top surface inward toward a bottom surface. A locking feature is disposed along the inner cavity and is configured to receive a fastening tool to allow the inner slug to be removed and inserted from an outer body.

In at least one embodiment, an interchangeable finger insert kit for a bowling ball is provided. An inner sleeve has a cylindrical opening defined at a top end. A base encloses a bottom end. A fastener-head feature is defined in the base and accessible through the cylindrical opening. An engagement feature is formed along an exterior surface and configured to allow the inner sleeve to be rotationally inserted into an internal bore. A fastening tool with an elongated shaft and a locking feature defined at a distal end of the shaft is provided. The locking feature is shaped to engage the fastener-head feature defined on the inner sleeve. The locking feature of the fastening tool engages the fastener-head feature on the inner sleeve, and rotation of the fastening tool is configured to rotate the inner sleeve into the internal bore thereby locking the inner sleeve in the bowling ball.

According to another embodiment, the cylindrical opening has a diameter greater than a maximum thumb-grip hole.

According to another embodiment, the kit has an inner thumb slug configured to be inserted and secured in the cylindrical opening of the inner sleeve.

According to another embodiment, the inner thumb slug has an access opening extending through the inner thumb slug from the top end to the fastener head feature in the base.

According to another embodiment, the inner thumb slug is secured to the inner sleeve with adhesive.

According to another embodiment, the kit has a cylindrical outer body configured to be disposed in a bowling ball hole, the outer body defining an internal bore having a corresponding engagement feature.

According to another embodiment, the outer body has a closed lower surface being elastically deformable, wherein the closed lower surface elastically deforms when the inner sleeve is fully seated.

According to another embodiment, the engagement feature on the inner sleeve has at least one helical groove.

According to another embodiment, the inner sleeve is formed of a material different than an inner slug material, the inner sleeve material having a strength greater than the inner slug material.

According to another embodiment, the fastener-head feature has a locking opening defined in the base of the inner sleeve.

According to another embodiment, the locking opening comprises a central keyed opening.

According to another embodiment, the locking opening includes side slots extending from central keyed opening.

According to another embodiment, the locking opening is a compound opening having at least two locking-opening portions.

In at least one embodiment, an interchangeable finger insert system for a bowling ball is provided. An inner assembly has an inner sleeve with a cylindrical opening defined at a top end and a base enclosing a bottom end. A fastener-head feature is defined in the base and is accessible through the cylindrical opening. The inner sleeve has an engagement feature formed along an exterior surface. An inner thumb slug is secured in the cylindrical opening of the inner sleeve and has an access opening extending through the length of the inner thumb slug to provide access to the fastener-head feature. A cylindrical outer body defines an internal bore being open at a first end of the outer body and having a corresponding engagement feature defined along an inside surface of the bore to cooperate with the engagement features on inner sleeve allow the inner assembly to be rotationally inserted into an internal bore. A fastener tool is adapted to interact with the fastener-head feature through the access opening, so rotation of the fastening tool rotates the inner assembly into the internal bore thereby locking the inner assembly in the bowling ball.

In at least one embodiment, an interchangeable finger insert for a bowling ball is provided. An insert sleeve has a cylindrical opening defined at a top end. The cylindrical opening is sized larger than a thumb-hole. A base encloses a bottom end of the insert sleeve. A fastener-head feature is defined in the base and is accessible through the cylindrical opening. An engagement feature is formed along an exterior surface of the sleeve to allow rotational insertion into an internal bore.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
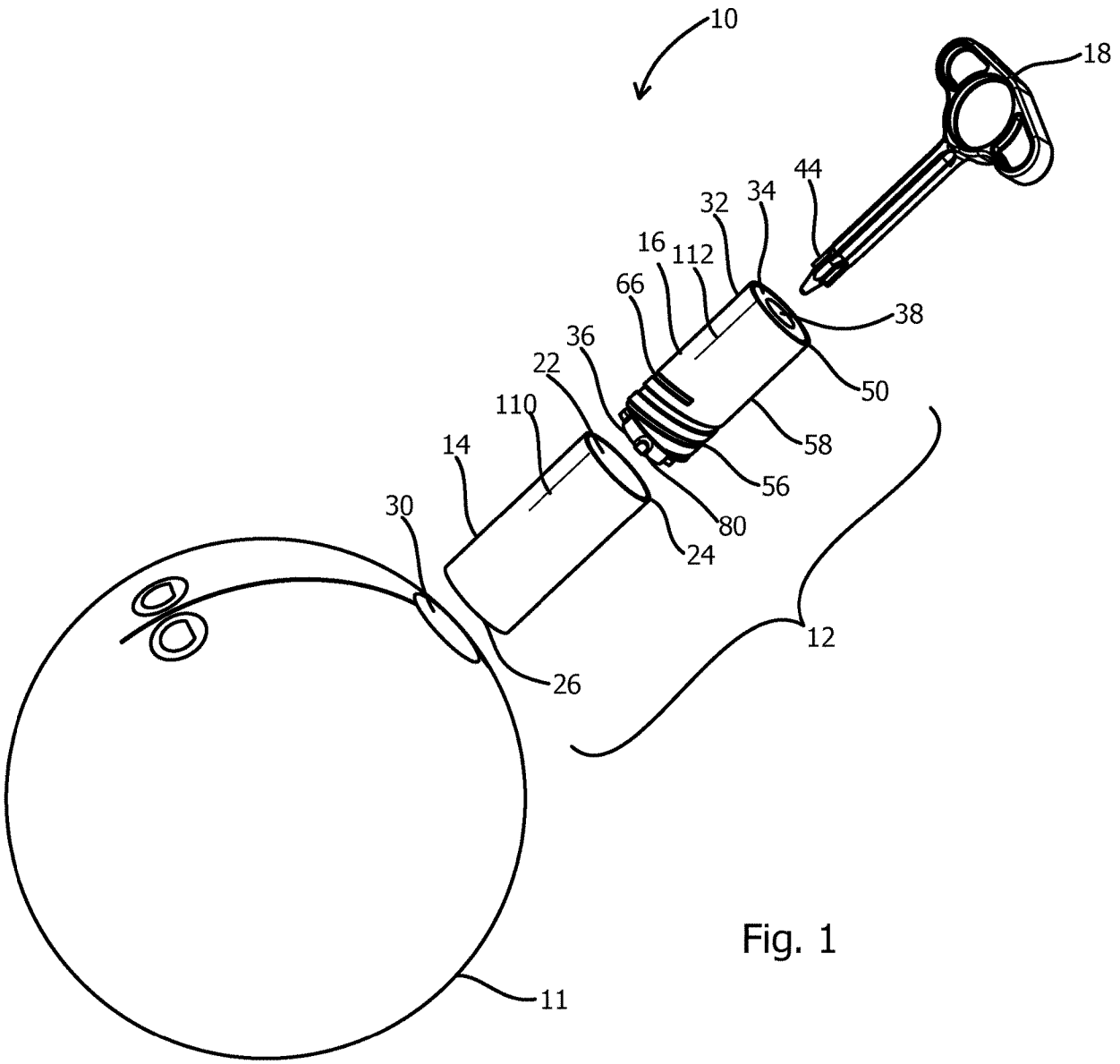
FIG. 1 illustrates a bowling kit with an interchangeable finger insert system and fastening tool shown removed from a bowling ball according to one embodiment.
Figure 2:
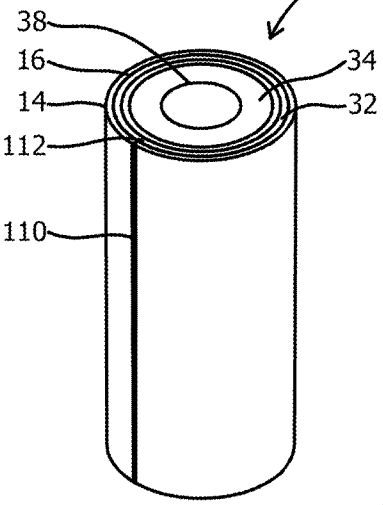
FIG. 2 is a top-side perspective view of the of the interchangeable finger insert system of FIG. 1.

FIGS. 1-8 illustrate and interchangeable finger insert kit 10 for a bowling ball 11, having a locking insert system 12 and fastening tool. As shown in FIG. 1, an interchangeable finger insert bowling system 10 for a bowling ball 11 is provided. The insert system 12 has an outer body 14, an inner assembly 16 and a fastening tool 18. The insert kit 10 also allows for a bowler to easily remove and insert the inner assembly 16 in to different bowling balls even after the inner assembly 16 has been drilled to the bowler's thumb size. U.S. Pat. No. 9,387,364 discloses an interchangeable finger insert for a bowling ball, the disclosure of which is hereby incorporated by reference in its entirety.

The outer body 14 is generally cylindrical with a hollow internal bore 22 defined by a first open end 24 being and a second end 26 enclosed by a lower surface. The outer body 14 may be affixed to the bowling ball 11 within a larger blind hole 30 that is drilled into the ball 11, with the lower surface 26 positioned closer to the center of the ball 11 and the open end 24 adjacent the periphery of the ball 11. The outer body 14 may be permanently attached to the bowling ball 11 with adhesive, for example.

The inner assembly 16 is configured to be removably inserted into internal bore 22 at the open end 24 of the outer body 14. The inner assembly 16 may be a single piece, or a multi-piece assembly. As shown in the FIGS. 1-6, the inner assembly 16 is formed of an inner sleeve 32 and an inner slug 34.

The inner sleeve 32 has a cylindrical opening extending from a top end 50. The cylindrical opening is sized to receive the inner slug 34. The cylindrical opening of the inner sleeve 32 is larger than a thumb hole. For example, the cylindrical opening may be 1.25-inches to receive a 1.25-inch inner slug. The cylindrical opening of the inner sleeve 32 may be larger to smaller to receive corresponding sized inner thumb slugs to be drilled with a thumb hole.

Figure 4A:
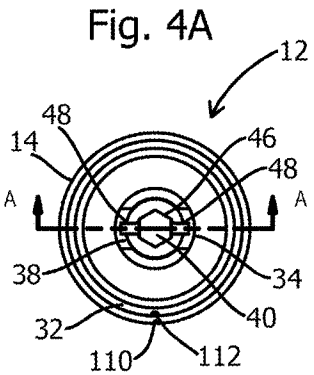
FIG. 4A is a top view of the interchangeable finger insert system of FIG. 1.
Figure 6B:
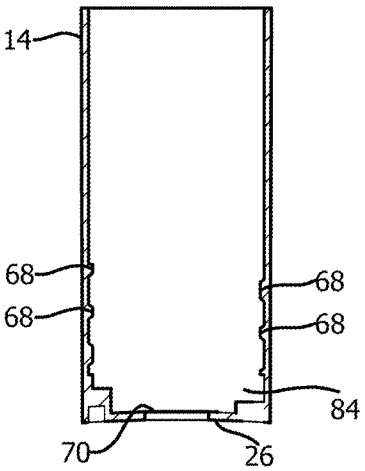
FIG. 6B is a cross-sectional view of the outer assembly in FIG. 4B with the inner assembly removed.
Figure 6A:
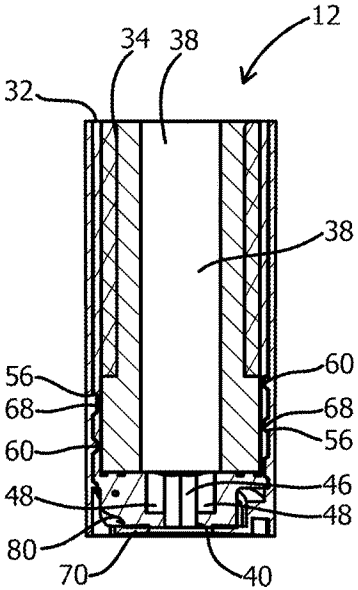
FIG. 6A is a cross-sectional view of the interchangeable finger insert system along the longitudinal central axis through section A-A in FIG. 4A.
Figure 4B:
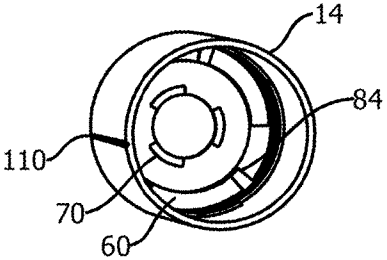
FIG. 4B is a top view of the outer body with the inner assembly removed.
Figure 5:
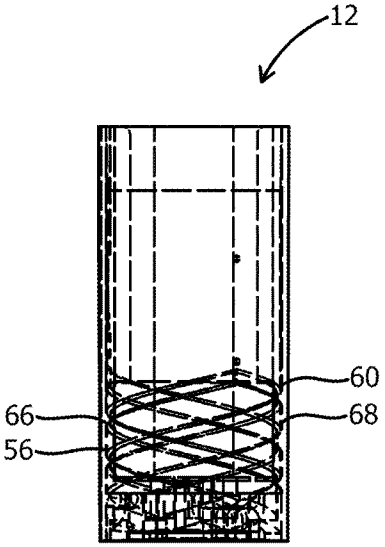
FIG. 5 is a side view of the interchangeable finger insert system of FIG. 5 showing the interior contours and components in broken lines.

As shown in FIG. 4A and FIG. 6A, in at least one embodiment, inner sleeve 32 has a fastener-head feature 40 formed in a base 54 of the inner sleeve 32 and accessible through the cylindrical opening from the top end 50. The fastener-head feature 40 is shaped to engage a locking feature 44 on the fastening tool 18. The locking feature 44 on fastening tool 18 may be a screw driver, such as a hex key, torque bit or similar locking feature. The fastener-head feature 40 may be an opening that cooperates with the locking feature 44 on fastening tool 18 and may be screw-driver shape opening or other shaped fastener-head as a person of ordinary skill in the art would understand.

In one embodiment, the fastener-head feature 40 may be a compound opening having at least two locking-opening portions. As shown in the top view in FIG. 4A, the fastener-head feature 40 has a keyed central opening 46 and opposing side-slots 48 extending from the central opening 46. The side-slots 48 may not extend through to the interior end but provide additional torque for fastening the inner assembly 16 to the outer body without damaging the locking opening. Other screw driver and fastener-head features are contemplated such as a slot, cross, philips, square, torx, hexagonal bolt head or any suitable fastening tool and cooperating locking feature. The fastener head feature 40 may be able to interact with more than one fastening tool. For example, the side-slots 48 may be able to interact with a flat-head fastening tool and the central opening 46 may be able to interact with a different fastening tool such as a hex key or cross driver, for example. The compound fastener opening provides greater surface already to allow the user to apply greater fastening torque without deforming or causing the opening to become stripped out.

The inner thumb slug 34 is secured to the inner sleeve 32. As shown in FIG. 6A, the inner slug has a top access opening 38 extending longitudinally through to the slug to allow access to the fastener-head feature 40 adjacent the interior end 36 of the inner assembly 16. The fastener-head feature 40 and locking feature 44 of the fastening tool 18 allow easy insertion and removal of the inner assembly 16 from the outer body 14 for the pro shop operator and/or the bowler.

The top access opening 38 in the inner assembly 16 allows for the fastening tool 18 to go through to find the fastener head feature 40. The top access opening 38 in the inner assembly provides several advantages including ease of pro shop installation access to the fastener-head feature 40 with the fastening tool 18 to lock in the inner assembly 16 to the outer body 14 before bowler's thumb size is drilled. The top access opening 38 also provides material/cost savings since the material that would be there would be drilled out anyway for a bowler's thumb size.

The cylindrical opening in the inner sleeve can receive an inner thumb slug 34 formed of any material based on the bowler's preference. In one embodiment, the inner slug 34 is formed of urethane. In another embodiment, the inner thumb slug 34 may be formed of rubber to provide more grip or tactile feel. However, the inner thumb slug 34 may be formed of any suitable material such as plastic, vinyl, urethane or material adapted to be drilled to a bowler's desired thumb size. The thumb cavity may be created with a custom shape as dictated for example, by a bowler's comfort or desired characteristics of ball trajectory.

Engagement features 56 are formed on the exterior surface 58 of the inner sleeve 32. The inner assembly engagement features 56 mate and engage with corresponding engagement features 60 on the outer body 14. In one example, the engagement features 56 on the inner assembly 16 may be a plurality of helical grooves 66. The corresponding engagement features 60 on the outer body 14 may be a plurality of protrusions 68 formed along on an inside surface of the internal bore 22 that corresponds to the shape of helical grooves 66. Upon a rotational insertion of the inner assembly 16, the protrusions 68 of the outer body 14 cooperate to engage and interlock with the grooves 66 of the inner assembly 16. In at least one embodiment the engagement features 56, 60 have approximately 14-degree angle on the threading that allows for about 360 degrees of rotation to create one inch of axial travel to fully seat the inner assembly 16 within the outer body 14. In another embodiment, the engagement features may have in the range of 10-degrees to 45-degrees of thread angle. It is contemplated that other thread angles may be suitable to balance slug retention in the ball in order to vary the overall rotation angle required to fully seat the slug during installation. Other engagement features are contemplated that allow rotational insertion and removal of the inner assembly 16 with the outer body.

The insert system 12 may also include a compression feature 70 to help retain the inner assembly 16 in the set position. The compression feature 70 may be a spring or elastomeric body or other compression feature that compresses to provide an outward force. The compression feature 70 may generate an outward resistive force between the outer body 14 and the inner assembly 16 as the inner assembly 16 is inserted into the internal bore 22 and provide positive engagement when the inner assembly 16 is fully seated. The outward force by the compression element 70 may help seat the inner assembly 16 and may also assist in removing the inner assembly from the outer body 14 and bowling ball 11. During insertion, the inner assembly 16 may compress the compression element to generate the resistive force.

According to one embodiment, the outer body 14 has a compression feature 70 formed with the closed lower surface 26. The closed lower surface 26 is formed to be elastically deformable and having an outer concave shape that protrudes inward into the inner bore 22 as shown in FIG. 6B. As the inner assembly 16 is inserted into the inner bore 22, the interior end 36 compresses the lower surface 26 of the outer assembly 14. As such, the closed lower surface 26 elastically deforms outward when the inner assembly 16 is fully seated, as shown in FIG. 6A, thereby providing a snap-fit and positive engagement feel as the user clicks the inner assembly 16 into the bowling ball 11.

Once the inner assembly engagement features 56 are fully seated with the corresponding engagement features 60 of the outer body 14, loads from bowling throws are distributed across a large portion of the exterior surface 58 of the inner assembly 16. This load distribution helps to avoid local stresses which may cause failure and detachment of the inner assembly 16 from the bowling ball 11.

While the material of the inner slug 34 is soft enough to easily drill or carve out the finger thumb insertion, the inner sleeve 32 is formed of a material having enough strength to remain engaged with the outer body 14 during the loading applied during a bowling throw and release. Further, the material of the inner sleeve 32 is durable enough to be removed and inserted in the outer body 14 multiple times without being damaged. In one embodiment, the inner slug 34 is formed of two-part urethane and the inner sleeve 32 may be formed of urethane, such as thermoplastic polyurethane (TPU) material having greater strength of than the inner slug 34 material. It is further contemplated that the materials may be selected such that the slug material yield strength is less than the inner sleeve material yield strength.

In at least one embodiment the outer body 14 is made of a thermoplastic acrylonitrile butadiene styrene (ABS) material, such as polycarbonate ABS. Alternatively, the injection grade thermoplastic Acetal may be similarly suitable. While the material described are provided by way of example, it is contemplated that other material combinations, both plastic and non-plastic, may be suitable for certain embodiments described herein.

Figure 3:
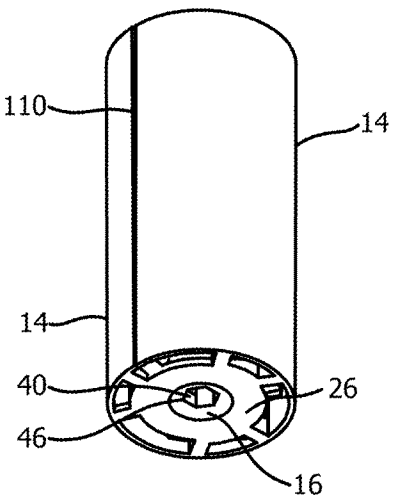
FIG. 3 is a bottom-side perspective view of the of the interchangeable finger insert system of FIG. 1.

The insert system 12 may also have locking features that operate to retain the inner assembly 16 within the outer body 14. The inner assembly 16 may have hook features 80 at the interior end 36, as shown in FIG. 1. The hook features 80 may extend radially from a centerline of the inner assembly 16. The lower surface 26 of outer body 14 may have corresponding receiving slots 84 to receive the hook features 80, as shown in FIG. 3. The hook features 80 are arranged to be inserted into the receiving slots 84 and cinched into the receiving slots 84 as the inner assembly 16 is rotated. The hook features 80 may be retained in the slots 84 with an interference fit. The design interference may provide a rotational resistance both into, and out of, the final set position.

Figure 8:
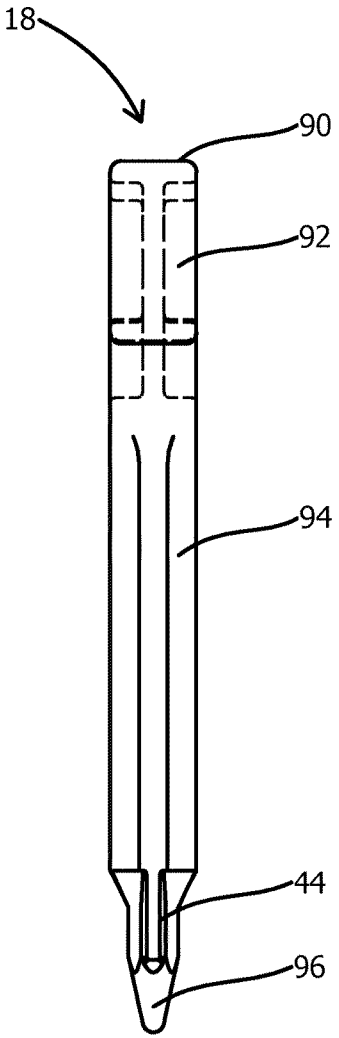
FIG. 8 is a side view of the fastening too shown in FIG. 1.
Figure 7:
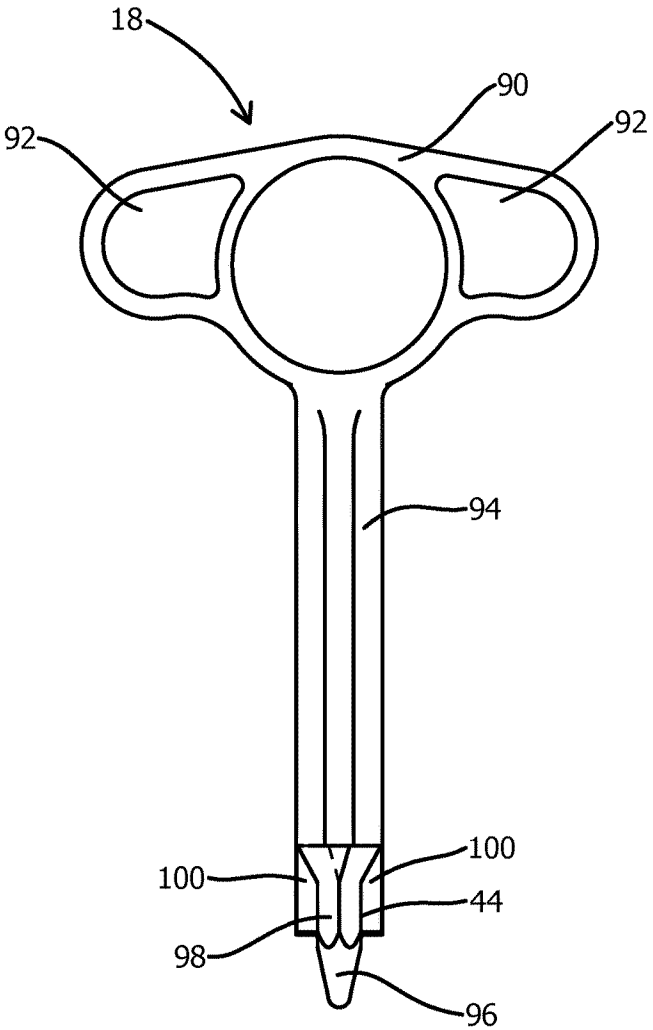
FIG. 7 is a front view of the fastening tool shown in FIG. 1.

As shown in FIG. 1, interchangeable finger insert kit may have a fastening tool 18 to alow the user to insert and remove the inner assembly 16. As shown in more detail in FIG. 7-8, the fastening tool 18 has a handle portion 90. The handle portion 90 may have wider flanges 92 for easy gripping by a user. An elongated shaft 94 extends from the handle portion 90. The elongated shaft 94 is designed to extend through the top access opening portion 38 of the inner assembly 16. As such the elongated shaft 94 is longer than the length of the access opening portion 38. The locking feature 44 is formed adjacent the distal end 96 of the fastening tool 18. In one embodiment, as shown in FIGS. 7-8, the locking feature 44 has a central key feature 98 to engage the central opening 46. The locking feature 44 also has side-tabs 100 to engage the side-slots 48. In another embodiment, the locking feature 44 of the fastening tool 18 may be a screw driver, such as a hex key, torque bit or similar locking feature that cooperates with a locking opening.

A method of assembling the insert system 10 is provided. Initially, the blind hole 30 in the bowling ball 11 is drilled. Line up a drill bit to the bowler's span and thumb pitches. Drill the blind hole 30 in the bowling ball with a diameter of 1.5-inch drill bit to a depth a stop collar on the drill bit. In one example, the stop collar ensures the blind hole 30 may approximately three-inches deep or more. Insert the outer body 12 into the blind hole 30 and align the alignment indicator 110 with a corresponding alignment position on the bowling ball 11. The outer body 12 may be secured in the blind hole 30 with adhesive.

Next, insert the inner assembly 16 into the outer body 14. The inner assembly 16 may initially be twisted by hand. The fastening tool is used to lock the inner assembly 16 to the outer body. In one embodiment, an inner alignment indicator 112 is aligned with the outer alignment indicator 110 when the inner body 16 is in the locked position. As shown in FIG. 4A, the alignment indicators 110, 112 may be a groove or scribed notch on the exterior surface on each of the inner assembly 16 and outer body 14. If any of the insert system 12 protrudes from the bowling ball, the insert assembly may be cut down to be flush with the bowling ball. The thumb hole is then drilled in the inner slug 54 to the bowler's desired thumb size and pitch. The thumb hole depth should be no longer than the length of the slug. The inner assembly 16 may be rotatably removed. If the thumb hole is tight on the bowler, it may be possible to use grip and friction forces to rotate and remove/insert the inner assembly 16. However, the fastening tool 18 allows the inner assembly 16 to be easily removed/inserted with less effort and prevents pain or injury with repeated installations.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An interchangeable finger insert for a bowling ball having an internal bore, the insert comprising:
- an inner assembly for having a thumb hole drilled therein, the inner assembly comprising:
  - a cylindrical sleeve extending from an open top end to a base enclosing a bottom end;
- an inner thumb slug secured in the sleeve and configured to have the thumb hole drilled therein;
  - a fastener-head feature defined in the base of the cylindrical sleeve and is accessible through an access opening in the inner thumb slug;
  - at least one helical groove formed along an exterior surface adjacent the bottom end and extending less than half a length of the cylindrical sleeve, configured to allow the inner assembly to be rotationally inserted into the internal bore;
- an outer body configured for securing to the internal bore of the bowling ball and having a hollow bore for receiving the inner assembly, the outer body having an engagement feature to engage the helical groove,
- wherein the helical groove has an angle to allow the inner assembly to be fully seated with rotation of only approximately 360-degrees; and
- a compression feature provided between the inner assembly and the outer body, wherein the compression feature is compressed as the inner assembly is seated in the outer body,
- wherein the outer body has a closed lower surface being elastically deformable and having an outer concave shape that protrudes inward into the internal bore, wherein the compression feature comprises the closed lower surface and elastically deforms when the inner assembly is fully seated to provide positive engagement force between the helical groove and the corresponding protrusion.

2. The insert of claim 1, wherein the outer engagement feature comprises a protrusion.

3. The insert of claim 1, wherein the fastener-head feature comprises a central keyed opening.

4. The insert of claim 1, further comprising a fastening tool with an elongated shaft, wherein a distal end of the shaft is shaped to interact with the fastener-head feature defined on the cylindrical sleeve and rotate the inner assembly into the outer body until the cylindrical sleeve is seated in the outer body.

5. The insert of claim 1, wherein an inner alignment indicator is formed on the inner assembly, and an outer alignment indicator is formed on the outer body, wherein the outer alignment indicator is aligned with the inner alignment indicator to align initial engagement of the helical grooves with the corresponding outer engagement feature and again when the inner assembly is fully seated in the outer body.

6. The insert of claim 1, wherein the inner thumb slug is formed of a different material than the sleeve.

7. The insert of claim 1, wherein the angle of the helical grooves is in the range of 10-degrees to 45-degrees.

8. An interchangeable finger insert kit for a bowling ball having an internal bore, the kit comprising:
- an inner assembly for having a thumb hole drilled therein, the inner assembly comprising:
  - an inner sleeve having a cylindrical opening defined at a top end and a base enclosing a bottom end,
  - an inner thumb slug secured in the cylindrical opening of the inner sleeve and having an access opening extending through the length of the inner thumb slug, wherein the inner slug is formed of a material having a yield strength less than the inner sleeve,
  - wherein a fastener-head feature is defined in the base of the inner sleeve and is accessible through the access opening in the inner slug;
  - at least one helical groove formed along an exterior surface of the inner sleeve;
- an outer body configured to be secured in the internal bore of the bowling ball and having at least one protrusion that engages the at least one helical groove as the inner assembly rotates into the outer body,
- a compression feature provided between the inner assembly and the outer body, wherein the compression feature is compressed as the inner assembly is seated in the outer body, wherein the outer body has a closed lower surface being elastically deformable and having an outer concave shape that protrudes inward into the internal bore,
- wherein the compression feature comprises the closed lower surface and elastically deforms when the inner assembly is fully seated to provide positive engagement force between the helical groove and the corresponding protrusion,
- wherein the inner assembly is fully seated in the outer body by rotation of only approximately 360-degrees; and
- a fastening tool with an elongated shaft, wherein a distal end of the shaft is configured to extend through the access opening to engage the fastener-head feature on the inner sleeve to rotate the inner assembly relative to the outer body.

9. The kit of claim 8, wherein the at least one helical groove is formed adjacent a bottom end of the inner sleeve and extends less than half a length of the inner sleeve, wherein the protrusion is formed adjacent a lower surface of the outer body.

10. The kit of claim 8, wherein the fastener-head feature comprises a keyed opening formed in base, wherein the distal end of the fastening tool engages the fastener-keyed opening on the inner assembly to rotate the inner assembly relative to the outer body.

11. The kit of claim 8, wherein the outer body has an outer alignment indicator and the inner sleeve has a corresponding inner alignment indicator, wherein the outer alignment indicator is aligned with inner alignment indicator to align initial engagement of the at least one helical groove with the at least one protrusion and again when the inner assembly is fully seated in the outer body.

12. The kit of claim 8, wherein the inner thumb slug is formed of a different material than the sleeve wherein the inner slug is formed of a material having a yield strength less than the inner sleeve.

13. The kit of claim 8, wherein the angle of the helical grooves is in the range of 10-degrees to 45-degrees.

* * * * *